United States Patent [19]

Fock et al.

[11] Patent Number: 4,579,776

[45] Date of Patent: Apr. 1, 1986

[54] BACKING SHEET FOR THE WEATHERING-PROOF COATING OF THIN, PLANE BACKING IN CONTINUOUS PRESSES WITHOUT RECOOLING

[75] Inventors: Jürgen Fock, Düsseldorf; Werner Schäfer; Dietmar Schedlitzki, both of Essen, all of Fed. Rep. of Germany

[73] Assignee: Th. Goldschmidt AG, Essen, Fed. Rep. of Germany

[21] Appl. No.: 638,865

[22] Filed: Aug. 7, 1984

[30] Foreign Application Priority Data

Aug. 17, 1983 [DE] Fed. Rep. of Germany ..... 3329679

[51] Int. Cl.[4] ..... B32B 27/10; B32B 27/08; B32B 27/30

[52] U.S. Cl. ..... 428/332; 428/340; 428/503; 428/514; 427/411; 427/316; 427/326; 427/391; 427/395; 156/307.3; 156/332; 156/335

[58] Field of Search ..... 428/332, 340, 503, 514; 427/411

[56] References Cited

U.S. PATENT DOCUMENTS 3,266,971 8/1966 Miller, Jr. ..... 428/503

FOREIGN PATENT DOCUMENTS 1421210 1/1976 United Kingdom .
1462499 1/1977 United Kingdom .

*Primary Examiner*—Patricia C. Ives
*Attorney, Agent, or Firm*—Toren, McGeady, Stanger, Goldberg & Kiel

[57] ABSTRACT

A backing sheet for the weathering-resistant coating of thin, plane backings in continuous presses without recooling comprising (A) a paper impregnated with curable melamine resin in an amount of 40 to 60 weight percent of aminoplast resin, based on the weight of the paper, in the dried state, and (B) a coating of curable acrylic resin on the impregnated paper in an amount of 60 to 150 g/m$^2$, the curable acrylic resin being a copolymer obtained by polymerizing:

(a) 60 to 80 weight percent of one or more alkyl methacrylate esters with 1 to 20 carbon atoms in the alkyl radical;

(b) 1 to 30 weight percent of one or more alkyl acrylate esters with 1 to 8 carbon atoms in the alkyl radical;

(c) 1 to 20 weight percent of an N-methoxymethylamide of acrylic acid, methacrylic acid, or mixtures thereof;

(d) 1 to 20 weight percent of a hydroxyalkyl ester of acrylic or methacrylic acid, with 2 to 4 carbon atoms in the alkyl radical;

(e) 1 to 20 weight percent of acrylamide or methacrylamide, the molar ratio of component (c) to the sum of (d) and (e) being about 1:1 and the ratio of (d) to (c) being 4:1 to 1:4;

(f) 0 to 35 weight percent of acrylonitrile, the sum of components (a) to (f) being 100 weight percent. The so-called endless laminates, fabricated by using the inventive backing sheet containing the selected acrylic resin, have a defect-free surface, even though the laminates were not recooled.

11 Claims, No Drawings

BACKING SHEET FOR THE WEATHERING-PROOF COATING OF THIN, PLANE BACKING IN CONTINUOUS PRESSES WITHOUT RECOOLING

BACKGROUND OF THE INVENTION

1. Field of the Invention

The invention relates to a backing sheet for the weather-proof coating of thin, flat panels in continuous presses without recooling, comprising (A) a paper which is impregnated with a curable melamine resin and, in the dried state, contains 40 to 60 weight percent of an aminoplast resin based on the weight of the paper, and (B) a curable acrylic resin coating which is applied onto the impregnated paper.

2. Description of the Prior Art

Coating wood-based panels in discontinuous presses with backing sheets which are impregnated with curable aminoplast resin and coated with curable polymerization resins, the resins of the backing sheet curing under the pressing conditions and forming a closed, defect-free surface, is well known.

For example, the fabrication of such backing sheets containing curable resin is described in German Pat. No. 23 50 794. According to this patent, the backing sheet is first impregnated with a solution of a urea-formaldehyde precondensate which optionally may contain additional melamine-formaldehyde resin and is then predried so that the backing sheet contains approximately 40 to 60 weight percent of aminoplast resin precondensate, based on the weight of the paper. Because of its water solubility, the aminoplast resin penetrates the hydrophilic paper fibers and envelops them. The dried backing sheet which contains still curable aminoplast precondensate is now coated with the aqueous dispersion of a curable two-phase copolymer, the copolymer containing a polymer of rubberlike elasticity dispersed in the matrix of a curable brittle polymer. This polymer of rubber-like elasticity is added in such an amount that a defect-free surface is formed during pressing, the surface layers having a high gloss and being crack-resistant, transparent, acid and alkali-resistant as well as relatively weathering-resistant after pressing.

These resin impregnated backing sheets are cured on wood-based panels at a pressure of 1.5 to $2.5\times10^6$ Pa and temperatures of 140° to 160° C. The size of the wood-based panel to be coated is limited by the size of the pressing surface of the press. It is of decisive importance for the formation of panels of the desired surface quality that after pressing, the panels are recooled to a temperature of about 50° C. Without this recooling, defects, e.g., glossy spots, opaqueness and bubble formation, develop in the surface.

A different method for fabricating surface coated panels, especially those resistant to weathering, consists of bonding a backing sheet containing a curable resin to a relatively thin, plane backing in continuous presses and gluing the laminate obtained to supporting panels, such as, for example, wood-based, wood-cement or asbestos-cement panels. As continuous presses, double belt presses are especially used for this purpose. In this case, the resin impregnated backing sheet and the thin, plane backing are guided between two continuous heated steel belts and the curing of the resins and the bonding of the two backings to each other takes place under pressure. However, with these continuous presses, there is no recooling of the surface coated laminate formed. Thus, when curable acrylic resin polymers known from the state of the art are used, laminates are obtained which have the above described surface defects, especially those of opaqueness and gloss defects.

In German Offenlegungsschrift No. 22 22 401 a process is described for fabricating backing materials for surface coating which are impregnated with aminoplastic binders and wherein (a) the backing materials are treated in a know manner with an aqueous preparation of a heat-curable aminoplast precondensate;

(b) optionally, are dried as an intermediate step; and then (c) a solution or dispersion of an acrylate ester copolymer which is compatible with formaldehyde condensates and curable at elevated temperatures, is applied on one side of the backing materials thus treated, (d) the composite subsequently being optionally dried and, if necessary, pressed at an elevated temperature.

As the acrylate ester copolymer, a copolymer should preferably be used of (a) 2 to 98 weight percent of units of at least one ester of (meth)acrylic acid with a monohydric alcohol having 1 to 8 carbon atoms, (b) 1 to 48 and, especially 5 to 35 weight percent, of copolymerized units of a monomer of the groups described in greater detail below:

($b_1$) N-methylol(meth)acrylamide or one of its ethers with a monohydric alcohol having 1 to 10 carbon atoms;

($b_2$) copolymerized monomers having free alcoholic hydroxyl groups, which were obtained by reacting acrylic acid or methacrylic acid with an at least dihydric alcohol with 2 to 20 carbon atoms;

(c) up to 25 weight percent of units of a polymerizable, unsaturated $\alpha$-olefinic carboxylic acid having 3 to 10 carbon atoms and/or a copolymerizable, unsaturated, olefinic monomer having basic groups; and (d) optionally, up to 88 weight percent of units of an additional unsaturated, olefinic, copolymerizable monomer.

It is intended that the copolymer be made more compatible with water by its content of carboxyl and/or basic groups. These polar groups, however, impair the ability of the cured surface layer to withstand weathering since moisture can penetrate more easily into the copolymer. This leads to opaqueness and the formation of small bubbles in the acrylic copolymer and therefore to considerable impairment of the decoration. On prolonged weathering, such surface coatings become gray and have uneven gloss. This graying and loss of gloss detract from the optical impression of the surfaces. Moreover, the penetrating moisture may cause damage and weathering of the surface.

SUMMARY OF THE INVENTION

We have discovered a way to provide backing sheets which are coated with a curable resin and can be processed in continuous presses, particularly double-belt presses, and which produce laminates having excellent surface properties, which can be glued onto panel-shaped materials in order to produce, for example, weathering-resistant facade elements, and which do not possess the above-noted defects.

More particularly, the present invention comprises a backing sheet of:

(A) a paper impregnated with curable melamine resin having 40 to 60 weight percent of aminoplast resin in the dried state, based on the weight of the paper, and (B) a coating of curable acrylic resin on the impregnated paper in an amount of 60 to 150 g/m$^2$, said curable acrylic resin being a copolymer obtained by polymerizing:

(a) 60 to 80 weight percent of one or more alkyl methacrylate esters with 1 to 20 carbon atoms in the alkyl radical, (b) 1 to 30 weight percent of one or more alkyl acrylate esters with 1 to 8 carbon atoms in the alkyl radical, (c) 1 to 20 weight percent of an N-methoxymethylamide of acrylic acid, methacrylic acid, or both;

(d) 1 to 20 weight percent of a hydroxyalkyl ester of acrylic or methacrylic acid with 2 to 4 carbon atoms in the alkyl radical, (e) 1 to 20 weight percent of acrylamide or methacrylamide, the molar ratio of component (c) to the sum of (d) and (e) being approximately 1:1 and the ratio of component (d) to (c) being 4:1 to 1:4, and optionally (f) 0 to 35 weight percent of acrylonitrile, whereby the sum of components (a) to (f) is 100 weight percent.

DESCRIPTION OF THE PREFERRED EMBODIMENTS

As the main component, the curable acrylic resin contains 60 to 80 weight percent of alkyl methacrylate ester with 1 to 20 carbon atoms in the alkyl radical, alkyl radicals with 1 to 4 carbon atoms being preferred. However, alkyl radicals with a higher number of carbon atoms, such as, the lauryl or stearyl radical, can also be used advantageously in the mixture.

Component (b) constitutes an alkyl acrylate ester with 1 to 8 carbon atoms in the alkyl radical. Especially preferred are alkyl radicals with 1 to 4 carbon atoms.

There exists a special relationship between components (c), (d) and (e), since these assure optimum curing. Component (c) is the N-methoxymethylamide of acrylic and/or methacrylic acid.

Component (d) is represented by a hydroxyalkyl ester of acrylic or methacrylic acid with 2 to 4 carbon atoms in the molecule.

Component (e) is acrylamide or methacrylamide.

In the invention, of essential importance is the ratio of components (c), (d) and (e) to each other, which is such that optimum curing characteristics are obtained. The molar ratio of component (c) to the sum of (d) and (e) should be about 1:1, while the molar ratio of component (d) to component (e) should be 4:1 to 1:4.

The polymer may contain up to 35 weight percent of acrylonitrile, with the proviso that the sum of the individual components must add up to 100 weight percent.

Plasticizers, such as, alkyl or aryl phthalates may be added in a known manner to the curable acrylic resins. In order to bring about rapid curing, it is advisable to add curing catalysts.

As curing catalysts, 0.1 to 2 weight percent of an acid catalyst may be added to the curable acrylic resins. The following are particularly suitable catalysts: p-toluenesulfonic acid, methanesulfonic acid, 2-chloroethyl phosphate, 2-ethylhexyl phosphate, 2-butoxyethyl phosphate, phosphoric acid, perchloric acid, vinyl phosphoric acid, and trivinyl phosphoric acid.

Conventional UV stabilizers may be added to the resin.

Corresponding to the conventional state of the art, the paper backing sheet is impregnated with the curable melamine resins from an aqueous solution. The dried, resin-impregnated backing sheet should contain about 40 to 60 weight percent of aminoplast resin, based on the weight of the paper.

Deviating from the art described in German Pat. No. 23 50 794, the curable acrylic resin is not applied in the form of an aqueous dispersion on the backing sheet containing the melamine resin, but is instead poured onto the backing sheet as a solution of the resin in organic solvents. Under continuous pressing conditions and especially under the conditions of the double-belt press, the curable polymerization resin is anchored better to the backing sheet containing the melamine resin, if an organic solution of the polymerization resin is used. The polymerization resin is used in such amounts that when pressed later, a closed, weathering-resistant surface is formed, whose thickness is at least 35 μm. As a rule, this corresponds to the application of at least 60 g/m$^2$.

The inventively impregnated and coated backing sheet is fabricated in a known manner by first impregnating the backing sheets with the aqueous solution of a curable aminoplast precondensate. In so doing, the cellulose fibers of the backing sheet should be enveloped completely. Usually therefore, aminoplast resin is introduced into the backing sheet in an amount corresponding to 50 to 100% (calculated as solid resin) of the weight of the paper. The backing sheets so obtained are dried, complete curing of the aminoplast resin being avoided.

The inventively coated backing sheet is added to the continuous press together with two to three thin plane backings. As thin, plane backings, melamine resin films and phenolic resin films as well as vulcanized fiber sheets have especially proven their value. The inventively impregnated backing sheet is pressed together with the plane backing at a temperature of 160°–190° C. and a pressure of 2 to $5\times10^6$ Pa, the residence time in the continuous press being about 30 to 60 seconds. The laminate formed by this procedure, whose resins have been cured in the press, leaves the continuous press and is pulled from the press without recooling and rolled up or cut into formats.

The so-called endless laminates, fabricated by using the inventive backing sheet containing the selected acrylic resin, have a defect-free surface, although the laminates were not recooled. The endless laminates can be processed further by known procedures, for example, by gluing them on wood-cement panels. The weathering properties of the surfaces formed meet the requirements. The resins are transparent and permit the decoration of the backing sheet to come through in an optically flawless manner.

The fabrication of the resin-impregnated backing sheets, the formation of the endless laminates and the use properties of panels provided with this endless laminate are described in greater detail in the following example.

EXAMPLE

(A) Synthesis of an Acrylate Copolymer in Solution

A mixture of 196 parts by weight of methylene chloride and 84 parts by weight of methanol is freed from dissolved oxygen by refluxing. Methylmethacrylate (201.6 parts by weight), 29.8 parts by weight of n-butyl methacrylate, 48.9 parts by weight of n-butyl acrylate, 18.0 parts by weight of methoxymethyl methacrylamide, 18.0 parts by weight of methacrylamide, 9.2 parts by weight of 2-hydroxyethyl methacrylate and 28.3 parts by weight of stearyl methacrylate are dissolved in 392 parts by weight of methylene chloride and 167 parts by weight of methanol. The solution is first of all freed once again from dissolved oxygen by refluxing it. Then 1.2 weight percent of azodiisobutyric nitrile, divided into equal amounts, is added over a period of 5 hours and the mixture is stirred for 12 hours at 60° C., a conversion of 99% of the theoretical being achieved.

The Staudinger index, determined at 20° C. in chloroform, is 1.08 (100 ml/g). The polymer is soluble in toluene, methylene chloride, acetone, ethylacetate and tetrahydrofuran.

(B) Preparation of a Coated Melamine Resin Film

A melamine-formaldehyde resin is synthesized in the usual manner by precondensing 157 parts by weight of a 37% aqueous solution of formaldehyde, 110 parts by weight of melamine, 3.5 parts by weight of aqueous sodium hydroxide solution (3 molar) and 30 parts by weight of chloroacetic acid.

To this precondensate are added 15 parts by weight of water and 15 parts by weight of ethylene glycol.

A decorative paper with an area weight of 80 g/m$^2$, is impregnated with the resin obtained. After evaporating the water, the area weight is 160 g/m$^2$; the volatile content is 4.5%.

The paper sheet, impregnated with melamine resin, is coated with the solution obtained as described in (A), to which 0.5 weight percent, based on the solution, of p-toluenesulfonic acid have been added; subsequently it is dried. A tack-free film with an area weight of 240 g/m$^2$ is obtained.

A film stored for 3 months showed unchanged flowability during treatment at elevated temperatures and under pressure.

(C) Fabrication and Properties of a Thin Laminate

The melamine resin film, coated with acrylate solution is bonded under pressure and at elevated temperatures together with a melamine resin support film, 80 g/m$^2$ paper weight, 120 g/m$^2$ resin weight and a vulcanized fiber sheet with an area weight of 120 g/m$^2$.

The laminating process is continuous in a double-belt press. The mode of operation of this machine is as follows:

Two steel belts running in opposite directions, are guided and driven by four heated drums. Between the drums, pressure is produced on the steel belt over a heated caul by means of compressed air through especially sealed nozzles.

From a roll-unwinding station, the sheets to be laminated are passed between the steel belts and then cured under pressure and heat and, after passing through the belt press, cooled without pressure on cooling rollers and rolled up on rolls. The pressing zone of the double-belt press is 2 m long, so that residence times of 6 to 60 seconds result. The specific pressure is of the order to 0.3 to $2\times10^6$ Pa; temperatures up to 190° C. can be produced in various zones using thermal oil.

The acrylate coated film together with the two base films, is processed at $1.8\times10^6$ Pa at a temperature of 175° C. in the inlet zones, and 190° C. in the middle zones, and at a rate of 2.5 m/min.

The laminate produced is 0.35 mm thick and very flexible so that it can be glued and molded on suitable weathering-resistant backing materials.

The surface is transparent with no opaque regions, free of bubbles and resistant to the effects of weathering.

We claim:

1. A backing sheet for the weathering-resistant coating of thin, plane backings in continuous presses without recooling comprising (A) a paper impregnated with curable melamine resin in an amount of 40 to 60 weight percent of aminoplast resin, based on the weight of the paper, in the dried state, and (B) a coating of curable acrylic resin on the impregnated paper in an amount of 60 to 150 g/m$^2$, the curable acrylic resin being a copolymer obtained by polymerizing:

(a) 60 to 80 weight percent of one or more alkyl methacrylate esters with 1 to 20 carbon atoms in the alkyl radical;

(b) 1 to 30 weight percent of one or more alkyl acrylate esters with 1 to 8 carbon atoms in the alkyl radical;

(c) 1 to 20 weight percent of an N-methoxymethylamide of acrylic acid, methacrylic acid, or mixtures thereof;

(d) 1 to 20 weight percent of a hydroxyalkyl ester of acrylic or methacrylic acid, with 2 to 4 carbon atoms in the alkyl radical;

(e) 1 to 20 weight percent of acrylamide or methacrylamide, the molar ratio of component (c) to the sum of (d) and (e) being about 1:1 and the ratio of (d) to (c) being 4:1 to 1:4;

whereby the sum of components (a) to (f) is 100 weight percent.

2. The backing sheet of claim 1 wherein the curable acrylic resin is applied to the paper from an organic solution thereof.

3. The backing sheet of claim 1 or 2 wherein the curable acrylic resin further contains from 0 to 35 percent of acrylonitrile.

4. The backing sheet of claim 1 or 2 wherein coating (b) is applied in an amount such that it has a thickness of at least 35 μm after pressing.

5. The backing sheet of claim 1 or 2 wherein the copolymer contains 0.1 to 2.0 weight percent, based on the copolymer of an acidic curing catalyst.

6. In a laminate of a weathering-resistant panel of two or more layers having a backing sheet thereon composed of a paper impregnated with an aminoplast resin and a curable acrylic resin thereon, the improvement which comprises said curable acrylic resin being present in an amount of 60 to 150 g/m$^2$ and being obtained by polymerizing:

(A) a paper impregnated with curable melamine resin in an amount of 40 to 60 weight percent of aminoplast resin, based on the weight of the paper, in the dried state, and (B) a coating of curable acrylic resin on the impregnated paper in an amount of 60 to 150 g/m$^2$, the curable acrylic resin being a copolymer obtained by polymerizing:

(a) 60 to 80 weight percent of one or more alkyl methacrylate esters with 1 to 20 carbon atoms in the alkyl radical;

(b) 1 to 30 weight percent of one or more alkyl acrylate esters with 1 to 8 carbon atoms in the alkyl radical;

(c) 1 to 20 weight percent of an N-methoxymethylamide of acrylic acid, methacrylic acid, or mixtures thereof;

(d) 1 to 20 weight percent of a hydroxyalkyl ester of acrylic or methacrylic acid, with 2 to 4 carbon atoms in the alkyl radical;

(e) 1 to 20 weight percent of acrylamide or methacrylamide, the molar ratio of component (c) to the sum of (d) and (e) being about 1:1 and the ratio of (d) to (c) being 4:1 to 1:4;

whereby the sum of components (a) to (f) is 100 weight percent.

7. The laminate of claim 6 wherein the curable acrylic resin is applied to the paper from an organic solution thereof.

8. The laminate of claim 6 or 7 wherein the curable acrylic resin further contains from 0 to 35 percent of acrylonitrile.

9. The laminate of claim 6 or 7 wherein coating (b) is applied in an amount such that it has a thickness of at least 35 $\mu$m after pressing.

10. The laminate of claim 6 or 7 wherein the copolymer contains 0.1 to 2.0 weight percent, based on the copolymer, of an acidic curing catalyst.

11. A method for preparing a backing sheet for the weathering-resistant coating of thin, plane backings in continuous presses without recooling comprising (a) impregnating a paper with a curable melamine resin in an amount of 40 to 60 weight percent of aminoplast resin, based on the weight of the paper, in the dried state; and (b) coating the paper with a curable resin in an amount of 60 to 150 g/m$^2$, the curable acrylic resin being a copolymer obtained by polymerizing:

(a) 60 to 80 weight percent of one or more alkyl methacrylate esters with 1 to 20 carbon atoms in the alkyl radical;

(b) 1 to 30 weight percent of one or more alkyl acrylate esters with 1 to 8 carbon atoms in the alkyl radical;

(c) 1 to 20 weight percent of an N-methoxymethylamide of acrylic acid, methacrylic acid, or mixtures thereof;

(d) 1 to 20 weight percent of a hydroxyalkyl ester of acrylic or methacrylic acid, with 2 to 4 carbon atoms in the alkyl radical;

(e) 1 to 20 weight percent of acrylamide or methacrylamide, the molar ratio of component (c) to the sum of (d) and (e) being about 1:1 and the ratio of (d) to (c) being 4:1 to 1:4;

whereby the sum of components (a) to (f) is 100 weight percent; by applying the acrylic resin from a solution thereof in an organic solvent.

* * * * *